United States Patent [19]

Webster

[11] Patent Number: 4,675,079

[45] Date of Patent: Jun. 23, 1987

[54] MULTI-NIP SUCTION PRESS WITH A FOUR ROLLER CLOSED TRAIN

[76] Inventor: David R. Webster, 320 Victoria Ave., Westmount, Montreal, H3Z 2M8, Quebec, Canada

[21] Appl. No.: 736,266

[22] Filed: May 21, 1985

Related U.S. Application Data

[63] Continuation of Ser. No. 449,645, Dec. 14, 1982, abandoned, which is a continuation of Ser. No. 281,914, Jul. 9, 1981, abandoned.

[51] Int. Cl.[4] ..... D21F 3/04

[52] U.S. Cl. ..... 162/360.1; 34/115; 100/118; 100/121

[58] Field of Search ..... 162/205, 206, 358, 360.1; 100/118, 121, 90, 161, 162; 34/115

[56] References Cited

U.S. PATENT DOCUMENTS

| | | | |
|---|---|---|---|
| 3,315,370 | 4/1967 | Hikosaka | 34/116 |
| 3,325,351 | 6/1967 | Orton, Jr. | 162/358 |
| 3,364,103 | 1/1968 | Kusters | 162/358 |
| 4,124,942 | 11/1978 | Ohls et al. | 34/115 |
| 4,173,249 | 11/1979 | Holkko et al. | 162/360.1 |

FOREIGN PATENT DOCUMENTS

| | | | |
|---|---|---|---|
| 267608 | 12/1912 | Fed. Rep. of Germany | 162/360.1 |
| 174203 | 11/1913 | Fed. Rep. of Germany | 162/358 |
| 15127 | of 1904 | United Kingdom | 162/360.1 |

*Primary Examiner*—S. Leon Bashore
*Assistant Examiner*—K. M. Hastings
*Attorney, Agent, or Firm*—Charles E. Brown; Charles A. Brown

[57] ABSTRACT

The present invention provides a drying apparatus for use in a papermaking machine and comprising at least four press rollers in nip contact with one another in succession in a closed train to define a substantially sealed chamber between the press rollers and chamber end walls. At least one of the press rollers is a hollow roller having a pervious outer wall to support at least one endless felt disposed for advance over an outer support surface of at least some of the rollers and passing through all of the nip contacts. The endless felt is a pervious carrier for a paper sheet to be dried. Resilient support means is provided for at least one press roller. Drive means is also provided for at least one press roller. Conduit means permits air movement through the hollow roller and the chamber. Air displacement means is connected to the conduit means. The air movement passes through the sheet carried on the felt whereby to extract moisture from the sheet and for convection of the moisture by the conduit means.

6 Claims, 3 Drawing Figures

MULTI-NIP SUCTION PRESS WITH A FOUR ROLLER CLOSED TRAIN

This is a continuation of application Ser. No. 449,645 filed Dec. 14, 1982, now abaondoned; which is a continuation of Ser. No. 281,914 filed July 9, 1981, now abondoned.

BACKGROUND OF INVENTION (a) Field of Invention

The present invention relates to papermaking and more particularly to pressing a sheet, such as paper, using at least four press rollers disposed in contact with one another along a circuit as a closed train to define a sealed chamber therebetween for the passage of air thereto and through the sheet via a pervious roller wall.

(b) Description of Prior Art

In papermaking, a wet slurry of pulp is formed into a continuous sheet by drainage at travelling-mesh means, then the formed sheet is pressed between rollers for more drainage, after which the sheet is dried by heat. As is well known in the art, removal of moisture by pressing is less costly than removal by heat. This is mainly because moisture removal by pressing utilizes little space, equipment and energy compared to moisture removal by heat. Heating is costly in the main because fuel is costly; a chain of equipment from fuel tank to paper-machine dryers comprises a great part of a paper mill, while a chain of energy exchanges from fuel tank to vapor exhaust at paper-machine dryers lose energy at every stage of energy exchange.

The present invention is directed toward removing moisture by the less costly means, namely pressing. As is also well known, pressing a sheet helps to interlock fibers for paper strength, and the present invention therefore is directed toward providing as many nips as possible in a small space. Multi-nip rollers are known for pressing a sheet to remove moisture thereof as is disclosed in U.S. Pat. No. 4,173,249 issued on Nov. 6, 1979 to Holkko. The present invention is an improved multi-nip suction press which overcomes some of the disadvantages of the prior art such as taught by the above referred to patent. The disadvantage of using a liquid press medium as in this reference is that it causes the sheet to re-pulp as it passes through the nips, as some of the water being squeezed out is trapped between the impervious sheets and opposed rollers forming the liquid medium chamber and redistributed into the pulp. Also, there is no means to extract the water from the nips and in the case of the upper nips, water will build up in that region as it cannot be released by gravity.

SUMMARY OF INVENTION

It is a feature of the present invention to provide a multi-nip suction press which substantially overcomes the above-mentioned disadvantages.

Another feature of the present invention is to provide a multi-nip suction press wherein air is utilized as a draining medium and passes through the pulp and into a sealed chamber formed between the nips of the press rollers to extract water from the pulp.

Another feature of the present invention is to provide a multi-nip suction press which is economic to operate compared to prior art devices and which results in energy conservation.

Another feature of the present invention is to guide a sheet of pulp through a closed train of rollers and registered with one another independent of diameter and speed.

Another feature of the present invention is to provide a multi-nip suction press wherein nip pressure may increase progressively as the sheet advances from nip to nip.

Another feature of the present invention is to provide a multi-nip suction press having the several nips disposed in succession along a closed train and wherein oscillations commonly caused in pressing the due to normal variations in felt weave are substantially cancelled.

Another feature of the present invention is to provide a multi-nip suction press having a central sealed chamber and pump means to displace air in that chamber to cause air to pass through the sheet to remove water therefrom.

According to the above features, from a broad aspect, the present invention provides a drying apparatus for use in a papermaking machine and comprising at least four press rollers in nip contact with one another in succession in a closed train to define a substantially sealed chamber between the press rollers and chamber end walls. At least one of the press rollers is a hollow roller having a pervious outer wall to support at least one endless felt disposed for a advance over an outer support surface of at least some of the rollers and passing through all of the nip contacts. The endless felt is a pervious carrier for a paper sheet to be dried. Resilient support means is provided for at least one press roller. Drive means is also provided for at least one press roller. Conduit means permits air movement through the hollow roller and the chamber. Air displacement means is connected to the conduit means. The air movement passes through the sheet carried on the felt whereby to extract moisture from the sheet and for convection of the moisture by the conduit means.

The present invention yields new results not present in prior art. Surface register is automatic, independent of roller diameters, because surface contact is obtained throughout the closed train. For example, surface travel in register continues, even though a roller be ground slightly smaller in diameter, and even though that roller rotates slightly faster than before. The reason of course is that surface contact around the closed circuit results in all press rollers having one surface speed in common. Also, a roll ground smaller than before is assured of nip contact, and air-tightness, with mating rollers by having resilient support means.

A chamber is formed by the press rollers, useful as an air box with positive or negative pressure, for air thorugh drying of a sheet when the chamber ends are sealed and connected to air-pump means. The press rollers themselves form the sides, top and bottom of the chamber and with end sealing walls, the press rollers combined thereby perform a new and useful function. In this new combination, air pressure in a pervious roller affects the pressure of that roller against its mating rollers whereby strength of that air pressure becomes a medium for controlling nip pressure.

In the present invention, a sheet is supported and carried from nip to nip without any open draw, important in avoiding sheet stress and breakage. This support eliminates need for a costly array of equipment for bringing nip speeds into register. Surface contact around the closed circuit maintains that register among nips.

In the present invention, any press roller disposed for air-through drying has a working arc that is substantial compared to conventional press rollers, thereby intensifying the drying process. When communication with air-pump means is through a roller periphery, air flow reverses through the periphery at each revolution thus back washing roll pores. In the present invention, roll pores retain their air pressure throughout a revolution, without exposure to the atmosphere, whereby sheet drying is intensified over known art. As a large portion of air-pumping energy is expended in changing the pressure of the roll pores, this new combination saves expending that energy at each revolution, and noise is correspondingly reduced. Through-drying is achieved in the present invention by any of several methods such as:

(a) Utilizing the above-mentioned air chamber as a conduit means having end sealing walls communicating with air-pump means;

(b) Utilizing peripheral seal means at a pervious roller arc juxtaposed from a sheet-and-felt wrapped arc and having hollow shafting for the pervious roller communicate with air-pump means. The peripheral seal means are preferably external to the pervious roller for maintaining air pressure in roll pores throughout a roll revolution;

(c) Utilizing external air-box means at a pervious roller arc juxtaposed from a sheet-and-felt wrapped arc and having conduit means between the air box and an air-pump means.

In the present invention, types of rollers may be chosen to suit best a roll location in that combination, because location in the roller circuit helps to determine whether a roller should be pervious or impervious, hard or soft, or be slightly bigger or smaller than mating rollers. These distinctive qualities of a press roller are somewhat analogous to distinctive qualities of chemical elements determining locations of elements along rings of organic chemical compounds. Also, press rollers may be added to whatever limits are practical, in forming a closed train. Comparing that closed train or circuit to a ring of an organic compound, complete rings may be added as an open series, integrally connected to adjoining rings without any open draw of sheet from ring to ring.

It is well known that two hard-surfaced rollers at a press nip quickly wear out a felt, while soft surfacing at least one of those rollers will prolong felt life. As is also well known, a damp sheet sticks to the smoother of two surfaces in a nip, and granite is used commonly for pressing directly against a damp sheet because its texture releases a sheet. Accordingly, a granite roller would be preferred in the present invention where a sheet touches a nip roll directly, but other surfaces would be acceptable in roller combinations for double felting because the sheet would no longer touch a press roll directly. Choice of suitable roller surface in this new combination would be apparent to those skilled in the art.

Return runs of felts are so well known as to stretch roll, guide roll, cleaning systems and variable configuration that they are not detailed herein. Likewise, felt rollers are not counted herein as press rollers, although they are necessary to the invention for guiding felts. Further, press framing is so well known as to support means and resilient mounting that framing is not detailed herein. Drive means is so well known for paper machine rollers including such as universal-joint drives, intermediate-roll drives and helper drives that drive means are not detailed herein. In addition, press rollers mentioned herein as being in rolling or nip contact are understood to have that contact through felting, and during operation through a sheet as well.

DESCRIPTION OF PREFERRED EMBODIMENTS

A preferred embodiment of the present invention will now be described with reference to the accompanying drawings, in which.

Figure 1:
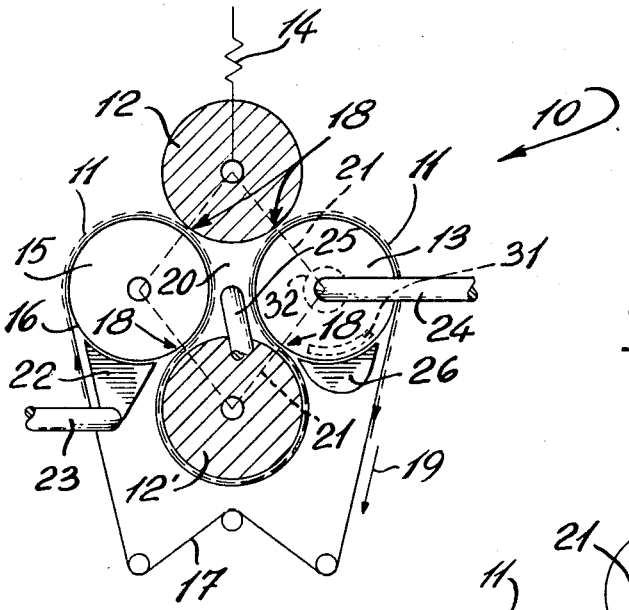
FIG. 1 is a schematic illustration of an example of the multi-nip suction press of the present invention.

Referring now to the drawings and more particularly to FIG. 1, there is shown the multi-nip suction press or drying apparatus of the present invention, as generally illustrated at 10. This apparatus is for utilization in a papermaking machine for pressing and drying a sheet of pulp stock 11. The press comprises at least four press rollers, herein stationary solid rollers 12 and 12', plus rollers 13 and 15. Roller 12 may be resiliently biased by biasing means schematically illustrated at 14. In this embodiment roller 12 touches the sheet directly and would preferably be of granite for sheet release. Rollers 13 and 15 could be soft surfaced while roller 12' could be hard surfaced. At least one of the rollers, herein roller 15 is a hollow roller having a pervious outer wall 16 in registry with endless belt 17 which is a pervious carrier of the paper stock of sheet 11 to be dried.

The four press rollers 12, 12', 13 and 15 are in close contact with one another in a succession as a closed train whereby to define nips at the area of contact therebetween and these are indicated by reference numeral 18. Thus, the four rollers will define four nips which will apply pressure on the endless felt and paper stock passing therebetween.

The endless felt 17 advances as indicated by arrow 19 and is a pervious carrier for the paper sheet whereby air may pass therethrough to convect water out of the pulp stock. One of the rollers has a drive connected thereto, by means well known in the art, for imparting rotation to all of the four rollers.

A substantially sealed chamber 20 is defined in the area between the rollers 12, 12', 13 and 15 and between chamber end walls 21, (herein shwon in phantom line). In order to achieve air movement between the pervious hollow roller 15 and the chamber 20, there is provided suitable conduit means which may be constructed in several ways. As shown in FIG. 1, an air box 22 is mounted in an external sealed relationship with another surface of the roll 15, and a conduit 23 is connected to the box 22 for the convection of air with moisture therein. Similarly, the roll 13 may be a pervious roller and may have a conduit 24 connected thereto for the convection of air and moisture. Rotation of roll 13 is accommodated at stationary conduit 24 by well-known rotary-joint means 32. A further conduit 25 is connected to one of the end walls 21 for the ingress of air under pressure. Thus, the chamber 20 will force air through the pulp stock and felt 17 passing through the pervious outer wall of rolls 13 and 15 thereby forcing moisture out of the pulp stock, through to the endless felt 17 and into the hollow rolls 13 and 15 for convection of air and moisture by conduits 23 and 24. It is pointed out that the roller 13 is suitably sealed in its opened area by means such as a solid shoe 26. By shoe 26 being external to roller 13, the rim of 13 remains continuously shielded from atmospheric pressure and the shoe is more accessible than an internal seal 31 would be.

In its operation, as the pulp stock enters the multi-nip press, water is squeezed out at a first nip. The pulp stock is then subjected to a suction by the hollow roller 15 in its travel area within the chamber 20. Thereafter the pulp stock is again squeezed at a second and third nip and enters into the chamber 20 for a second travel while subjected to a suction along a surface area of the second press roler 13. Thus, the paper stock exits the multi-nip press in a drier condition than possible with known prior art multi-nip press devices.

Figure 2:
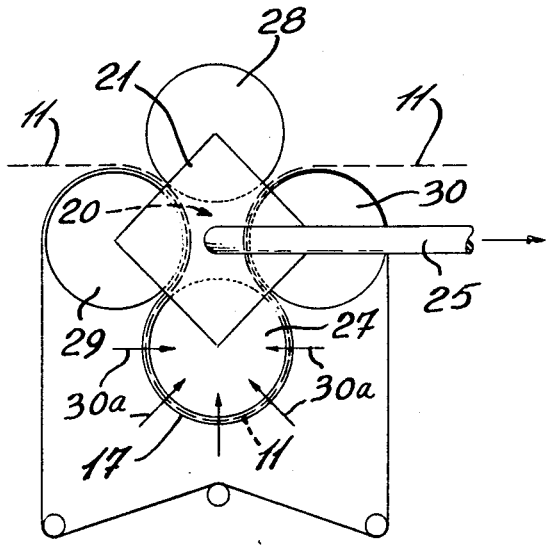
FIG. 2 is a schematic illustration of a still further example of the multi-nip suction press of the press invention.

Referring now to FIG. 2 there is shown another example of the conduit means. As herein shown, a single hollow roller is provided with a pervious surface and resiliently biased against three other rollers. For example, roller 28 may be a granite solid roller and rollers 29 and 30 may be rubber rollers. Air is exhausted from the chamber 20 via the exhaust conduit 25 and this causes an ingress of air, as shown by arrows 30A through the felt 17 and the paper stock which is located between the felt and a large outer surface portion of the pervious roller 27 causing moisture to be drawn within the roller 27 and exhausted through conduit 25 via the central chamber 20. The invention should not be limited to the combinations of the air convection means disclosed herein, as other arrangements of air convection are possible.

Figure 3:
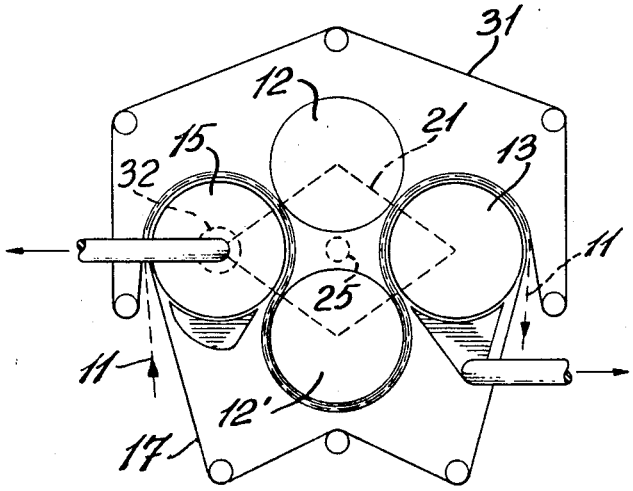
FIG. 3 is a schematic illustration of a still further example of the multi-nip suction press as utilized in a double felted press.

Referring now to FIG. 3, there is shown the invention as utilized in a double felted press. As herein shown, a second endless felt 31 is driven in an endless manner about the rollers 12, 12', 13 and 15 and in registry with the other endless felt 17. The pulp stock 11 is trapped between the felts. Both endless felts are of a porous construction. The operation of the double felted press, for the removal of moisture of the pulp stock, is the same as that disclosed for FIG. 1.

It is within the ambit of the present invention to cover any obvious modifications of the examples of the preferred embodiment described herein. For example, the multi-nip suction press may comprise six rollers defining a chamber therebetween with air being injected into the chamber and out of four pervious rollers. In a still further foreseeable arrangement there may be provided seven rollers, three axially aligned with two pairs of granite rollers in nip contact between these whereby to define two sealed chambers with the exhaust being made through three pervious rollers and air fed to both of the chambers.

In another example of seven rollers in accordance with the invention there may be one roller fixed centrally, three plain rollers at substantially 120 degree locations in external nip contact therewith, two pervious rollers each in nip contact with two of the three plain rollers and one sealing roller in nip contact with two of the three plain rollers whereby to define chamber means at substantially 120 degree directions outside the roller fixed centrally.

I claim:

1. A four nip press for drying a web of material comprising four press rollers each mounted for rotation about respective parallel axes, said four press rollers being positioned relative to each other such that each roller is in pressing contact with two other rollers forming nips therebetween to thereby provide a closed train of rollers, means defining with said four press rollers an enclosed central zone into which said web is received through a first of said nips and passing circumferentially over at least one of said press rollers in the central zone and discharged therefrom through a second of said nips; means for maintaining said web in circumferential contact with said at least one press roller in the central zone, said at least one press roller being a porous cylinder and having a hollow interior; said second nip including said porous cylinder at least one press roller and a non-porous second one of said press rollers, means resiliently urging together said porous cylinder at least one press roller and said non-porous second press roller, means for providing a gaseous pressure differential between said central zone and the hollow interior of said at least one press roller, said means including gas inlet and exhaust means for circulating a gas to said enclosed central zone and the interior of said at least one press roller, such that said gas will flow from one of said central zone and the interior of said at least one press roller through said web to the other of said central zone and interior of said at least one press roller in order to remove water from said web, a papermaking press felt supporting said web and said papermaking press felt being porous allowing the gas to pass therethrough between the central zone and the interior of said at least one press roller, said papermaking press felt with respect to said at least one press roller being downstream of the web with respect to the direction of gas flow through said web, said web and said papermaking press felt passing circumferentially over said non-porous second press roller exteriorly of said central zone with said web being between said papermaking press felt and said non-porous second press roller.

2. A press as defined in claim 7, wherein at least one of said nips has means for providing a greater pressure to said web than the others of said nips to thereby control the flow rate of moisture drainage from the web.

3. A four nip press as defined in claim 1, wherein the first nip is defined by the first and fourth press rollers, the first press roller being said at least one of said press rollers such that the first press roller is hollow and the wall thereof is porous, the web re-enters the central zone at the third nip formed between the second press roller and the third press roller, the web passing circumferentially over the third roller in the central zone and is discharged through a fourth nip formed between the third press roller and the fourth press roller.

4. A four nip press as defined in claim 1, wherein the third press roller also is a porous cylinder having a hollow interior and the means for providing a gas pressure differential between the central zone and the hollow interior of said first press roller also provides a pressure differential between the central zone and the hollow interior of said third press roller, said means including gas inlet and exhaust means for circulating a gas to said enclosed central zone and the interior of said fist and third press rollers, such that gas will flow from one of said central zone on the one hand and the interiors of said first and third press rollers on the other hand through said web to the other of said central zone on the one hand and the interior of the first and third press rollers on the other hand through said web to the other of said central zone on the one hand and the interior of the first and third press rollers on the other hand in order to remove water from the web.

5. A four nip press as defined in claim 1, wherein the pressure differential across the web is caused by a gas being fed under pressure directly into the central zone and exhaust means communicating with the interior of said at least one press roller such that the gas flow is from the central zone first through the web and then through said papermaking press felt into the interior of said at least one press roller through to the exhaust in order to remove water from the web.

6. A four nip press as defined in claim 1, wherein the means for maintaining the web in circumferential contact with the at least one press roller includes a second papermaking press felt with said papermaking press felts sandwiching the web at the first of said nips and carrying the web over the circumference of the said at least one press roller within the central zone.

* * * * *